US011707178B2

(12) United States Patent
Busken-Jovanovich

(10) Patent No.: US 11,707,178 B2
(45) Date of Patent: Jul. 25, 2023

(54) SHOE CLEANING APPARATUS AND METHOD

(71) Applicant: BISSELL Inc., Grand Rapids, MI (US)

(72) Inventor: Isaac Busken-Jovanovich, Cincinnati, OH (US)

(73) Assignee: BISSELL Inc., Grand Rapids, MI (US)

( * ) Notice: Subject to any disclaimer, the term of this patent is extended or adjusted under 35 U.S.C. 154(b) by 590 days.

(21) Appl. No.: 16/802,982

(22) Filed: Feb. 27, 2020

(65) Prior Publication Data

US 2020/0275821 A1 Sep. 3, 2020

Related U.S. Application Data

(60) Provisional application No. 62/811,901, filed on Feb. 28, 2019.

(51) Int. Cl.

| | |
|---|---|
| ***A47L 23/02*** | (2006.01) |
| ***B08B 7/00*** | (2006.01) |
| ***B08B 3/02*** | (2006.01) |
| ***A47L 23/26*** | (2006.01) |

(52) U.S. Cl.

CPC ..... *A47L 23/02* (2013.01); *A47L 23/26* (2013.01); *B08B 3/02* (2013.01); *B08B 7/0035* (2013.01)

(58) Field of Classification Search

CPC ..... A47L 23/26; A47L 23/18; A47L 23/22; A47L 23/28; A47L 23/263; A47L 23/02; B08B 3/02; B08B 7/0035

USPC ..... 15/265, 320

See application file for complete search history.

(56) References Cited

U.S. PATENT DOCUMENTS

| | | | | |
|---|---|---|---|---|
| 2,448,931 | A | 9/1948 | Swanson | |
| 2,482,882 | A | 9/1949 | Swanson | |
| 2,895,159 | A | 7/1959 | Ostrow | |
| 3,064,298 | A | 11/1962 | Jones | |
| 3,203,020 | A | 8/1965 | Merkel | |
| 3,786,531 | A | 1/1974 | Borg | |
| 4,027,355 | A | 6/1977 | Mead et al. | |
| 4,280,244 | A | 7/1981 | Spirig | |
| 4,733,424 | A * | 3/1988 | Gurkin | A47L 23/266 15/268 |
| 5,771,528 | A | 6/1998 | Nappi, Sr. | |
| 5,881,427 | A | 3/1999 | Offner | |
| 7,073,226 | B1 | 7/2006 | Linkiewicz et al. | |
| 7,228,589 | B2 | 6/2007 | Miner et al. | |

(Continued)

FOREIGN PATENT DOCUMENTS

| | | | |
|---|---|---|---|
| JP | H0690891 | A | 4/1994 |
| WO | 2000078201 | A1 | 12/2000 |

OTHER PUBLICATIONS https://dornob.com/this-entry-rug-sucks-vacuum-floor-mat-cleans-your-shoes/, DORNOB.com, "This Entry Rug Sucks, Literally", accessed Feb. 21, 2020.

*Primary Examiner* — Thomas Raymond Rodgers

(74) *Attorney, Agent, or Firm* — Warner Norcross + Judd LLP

(57) ABSTRACT

A shoe cleaning apparatus and method configured for cleaning a user's shoes while the user is wearing said shoes. A cleaning solution can be supplied by the shoe cleaning apparatus and operation of the shoe cleaning apparatus can agitate the surface of the shoe and the cleaning solution. The shoe cleaning apparatus can be provided as part of a decorative or storage unit, entry system, portable system, or built-in system.

18 Claims, 5 Drawing Sheets

(56) References Cited

U.S. PATENT DOCUMENTS

| | | | | |
|---|---|---|---|---|
| 7,472,452 | B2 | 1/2009 | Junell | |
| 7,725,974 | B2 | 6/2010 | Hughes | |
| 8,533,888 | B2 | 9/2013 | Kessler | |
| 8,973,197 | B2 | 3/2015 | Omidi | |
| 2008/0104782 | A1* | 5/2008 | Hughes | A47L 23/05 15/112 |
| 2015/0108244 | A1 | 4/2015 | Pruiett et al. | |

* cited by examiner

SHOE CLEANING APPARATUS AND METHOD

CROSS-REFERENCE TO RELATED APPLICATION(S)

This application claims the benefit of U.S. Provisional Patent Application No. 62/811,901, filed Feb. 28, 2019, which is incorporated herein by reference in its entirety.

BACKGROUND

Tracked dirt and debris from footwear can be can unattractive as well as harmful. This is true in homes, work places, and in medical facilities. Rubber mats or carpeting are often used at entrances to homes or buildings for users to wipe shoes; however, this merely removes a small amount of lose dirt and grime at best.

BRIEF DESCRIPTION

An aspect of the present disclosure relates to a shoe cleaning apparatus, comprising a housing assembly operably coupled to the platform, a platform having an upper surface adapted to receive footwear for cleaning, a fluid delivery system fluidly coupled to the upper surface and configured to provide a cleaning fluid thereto, and a fluid recovery system fluidly coupled to the upper surface and including a suction source.

DETAILED DESCRIPTION

Aspects of the present disclosure relate to a shoe cleaning apparatus for cleaning a shoe(s) of a user while wearing. The term "shoes" is used herein to describe a variety of footwear including sneakers, boots, heels, etc. and is used interchangeably with the term footwear. It is noted that the shoe cleaning apparatus may have a variety of applications including both commercial and consumer or home based.

One commercial industry that may find the shoe cleaning apparatus particularly useful is that of the medical industry where contaminants and bacteria on footwear can track in hazards into a patient room or other area such as a surgical unit or laboratory. Hospital acquired infections can affect five to ten percent of hospitalized patients in the U.S. per year. Approximately 1.7 million hospital acquired infections occur in U.S. hospitals each year, resulting in 99,000 deaths and an estimated $20 billion in healthcare costs. Footwear tracks in a variety of contaminants, toxins, and otherwise into an environment that is intended to provide a healing environment and promote health and well-being.

Figure 1:
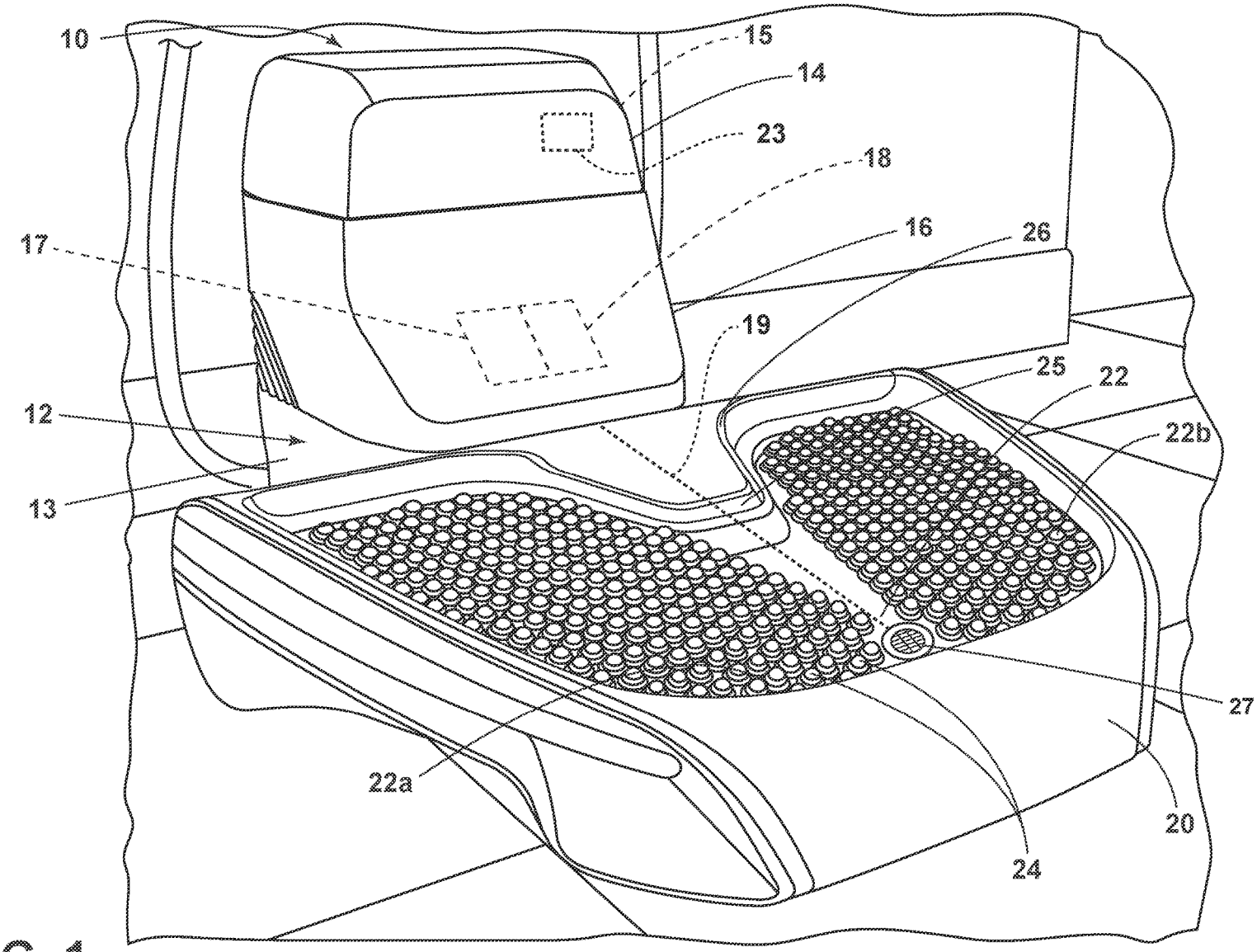
FIG. 1 is a perspective view of a shoe cleaning apparatus according to various aspects described herein.

FIG. 1 illustrates a system for cleaning shoes of a user while wearing. The system includes a shoe cleaning apparatus in the form of an exemplary shoe cleaning apparatus 10 also referred to herein as a shoe cleaner. The functional systems of the exemplary shoe cleaning apparatus 10 can be arranged into any desired configuration, such as a device having minimal or no supply and recovery tanks but directly coupled to a household or commercial plumbing system, a portable device adapted to be hand carried by a user, or a device suitable to be located without plumbing hook-ups but intended for more stationary use such as combined with a decorative or storage unit, entry system, or built-in system.

The shoe cleaning apparatus 10 can include a fluid delivery system 12 having at least one fluid container 13 such as a fluid supply container for storing cleaning fluid and delivering the cleaning fluid to a base 20 having a platform 22 and a recovery system 14 such as a fluid recovery system for removing the spent cleaning fluid and debris from the platform 22 and separating or storing the spent cleaning fluid and debris.

The platform 22 has been illustrated as having a left side 22*a* and a right side 22*b* for accommodating left and right shoes of a user, simultaneously. It is contemplated that the platform can be of any suitable material including silicone and that nubs 24 or other agitators, grips, etc. can be provided thereon to facilitate cleaning on a wet surface.

A housing 16 of the shoe cleaning apparatus 10 contains a pump 17 for the fluid delivery system 12 as well as a suction source 18 of the recovery system 14.

The fluid delivery system 12 can include at least one fluid container 13 for storing a supply of fluid. The fluid can include one or more of any suitable cleaning fluids, including, but not limited to, water, compositions, concentrated detergent, diluted detergent, etc., and mixtures thereof. For example, the fluid can include a mixture of water and concentrated treating chemistry. The fluid delivery system 12 can generally include a flow control system, including the pump 17, for controlling the flow of fluid from the at least one fluid container 13 to the fluid distributor 25 having at least one outlet located on or adjacent the platform 22. By way of non-limiting example, the fluid distributor 25 is illustrated as an opening in the platform 22 extending along a top edge thereof. The fluid distributor 25 can comprise any structure, such as a nozzle, spray tip, spray bar, fountain, etc. The fluid distributor can be positioned to deliver fluid directly to the platform surface, or indirectly by delivering fluid onto an agitator on the base 20.

Figure 2:
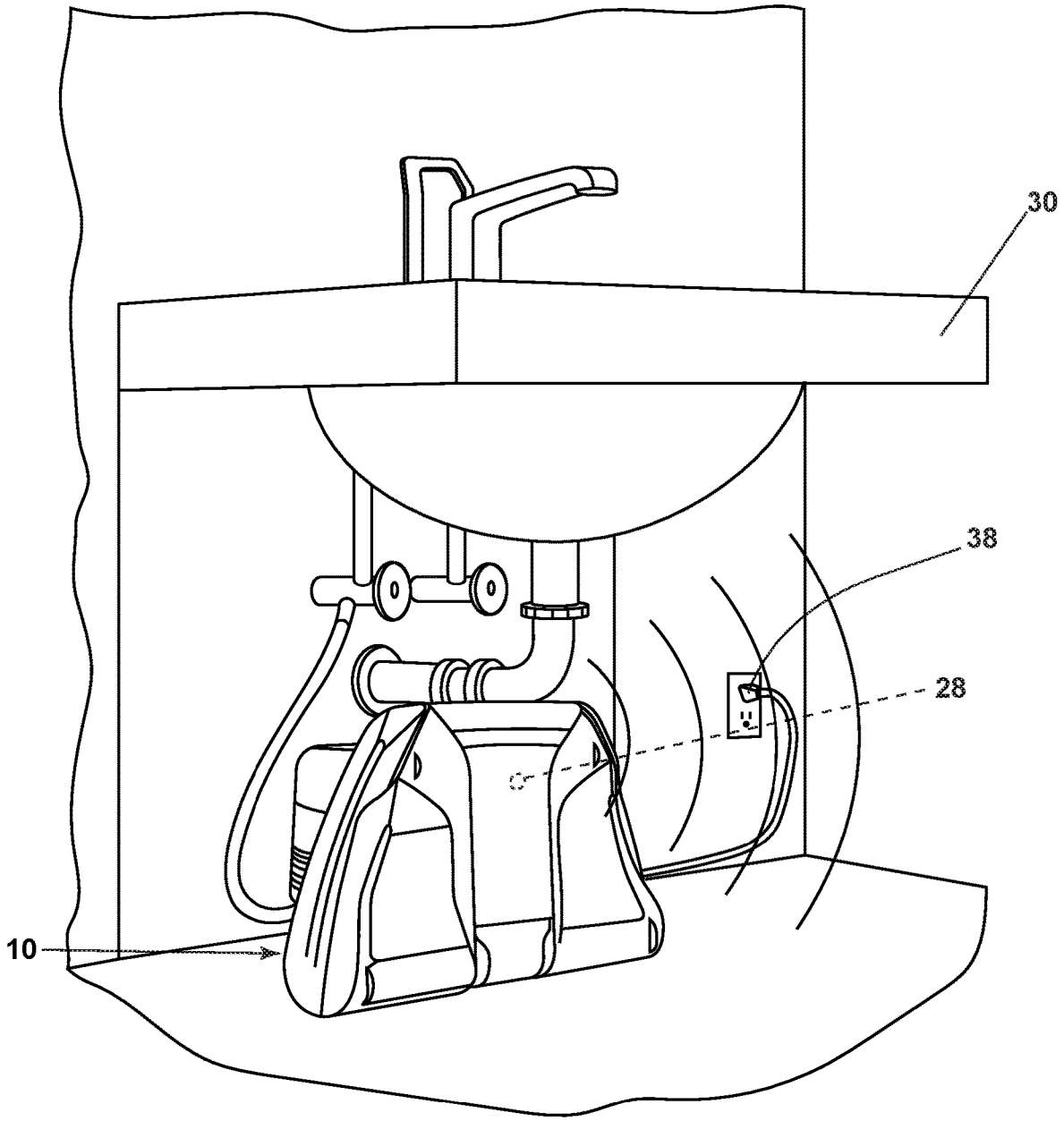
FIG. 2 is a perspective view of the shoe cleaning apparatus of FIG. 1 installed and in a stored position.

In one configuration, the flow control system can include at least one pump such as the pump 17, which pressurizes the fluid delivery system 12 and a flow control valve, which controls the delivery of fluid to the distributor(s) at the platform 22. In one example, the pump can be coupled with the power source 38 (FIG. 2). An actuator can be provided to actuate the flow control system and dispense fluid to the distributor(s) at the platform 22. The actuator can be operably coupled to the valve such that pressing the actuator will open the valve. The valve can be electrically actuated, such as by providing an electrical switch between the valve and the power source 38 (FIG. 2) that is selectively closed when the actuator is pressed, thereby powering the valve to move to an open position. In one example, the valve can be a solenoid valve. Alternatively, the actuator can be operably coupled to a sensor that senses a user's presence and actuates based thereon. For example, the sensor can include a weight or mass sensor that senses a user has stepped onto the platform 22.

As another option, the fluid delivery system 12 can be provided with at least one additional container for storing a cleaning fluid. For example, the first container can store water provided by the water inlet 32 and an additional container can store a cleaning agent such as detergent. Such first and second containers can, for example, be defined by a supply tank and/or a collapsible bladder. Alternatively, a single container can define multiple chambers for different fluids. In the case where multiple containers are provided, the flow control system can further be provided with a mixing system for controlling the composition of the cleaning fluid that is delivered to the platform 22. The composition of the cleaning fluid can be determined by the ratio of cleaning fluids mixed together by the mixing system. As shown herein, the mixing system includes a mixing manifold that selectively receives fluid from one or both of the containers. A mixing valve is fluidly coupled with an outlet of the additional container, whereby when mixing valve is open, the second cleaning fluid will flow to the mixing manifold. By controlling the orifice of the mixing valve or the time that the mixing valve is open, the composition of the cleaning fluid that is delivered to the platform 22 can be selected.

The recovery system 14 can include at least one inlet 27 located at or adjacent the platform 22 and in fluid communication with the suction source 18 for generating a working fluid path, and a recovery container 15 for separating and collecting fluid and debris from the working airstream for later disposal. A working air conduit 19 extends from the inlet 27 to the recovery container 15. The at least one inlet 27 can be thought of as a suction nozzle(s) that can be provided on or adjacent any suitable portion of the platform 22. A separator 23 can be formed in a portion of the recovery container 15 for separating fluid and entrained debris from the working airstream. The suction source 18 can be any suitable suction source, such as a motor/fan assembly, which is provided in fluid communication with the recovery container 15. The motor/fan assembly can be electrically coupled to a power source 38 (FIG. 2), such as a battery or by a power cord plugged into an electrical outlet.

It is contemplated that an optional diverter assembly (not shown) can selectively couple the suction nozzle(s) to the suction source 18.

It will be understood that the specifics of the fluid delivery system and fluid recovery system are much like that of a portable extraction cleaner. The shoe cleaning apparatus 10, whether portable, built-in, or installed, can include any or all of the various systems and components described herein, including at least a fluid delivery system for storing and delivering a cleaning fluid to the platform 22 and a recovery system for extracting the dispensed cleaning fluid, dirt and debris from the platform 22. Fluid delivery systems and fluid recovery systems including pumps, valving, containers, seals, suctions sources, etc. are set forth in detail in U.S. Pat. No. 7,073,226, filed Nov. 27, 2002, and titled "Portable Extraction Cleaner," U.S. Pat. No. 7,228,589, filed Mar. 31, 2004, and titled "Unattended Spot Cleaning Apparatus," and U.S. Patent Publication No. 2015/0108244, filed Oct. 15, 2014, and titled "Apparatus for Cleaning a Surface," all of which are incorporated herein by reference in their entirety. Such references describe portable extractors, which can generally describe a portion of the shoe cleaning apparatus 10 to which the base 20 can be operably coupled with. While the shoe cleaning apparatus 10 has been illustrated as being connected with fluid and disposal plumbing infrastructure it will be understood that this need not be the case and that the shoe cleaning apparatus 10 can be standalone.

At least one ultraviolet emitting light element, herein UV light emitting element 26, is also located on the base 20 adjacent the platform 22. The UV light emitting element 26 preferably comprises a conventional UV lamp. Alternately, the UV light emitting element 26 a plurality of UV emitting LEDs. The UV light emitting element 26 can be fixedly received within a mounting channel in the base 20 and can be connected to a controller (not shown) and power source 38. The UV light emitting element 26 can be selected from a range of optional light emitting elements based on the desired effect and dictated by the wavelength properties associated with the light element. Alternatively, the light on the upper portion of the base can be an indication light. Further still, another UV light emitting element 66 can be located underneath the platform 22 (see FIG. 5) and light can be allowed to reach a sole of a user's footwear therefrom.

As illustrated in FIG. 2, the shoe cleaning apparatus 10 can also include a motion sensor 28 for determining a presence of a user. Such motion sensor 28 can include, by way of non-limiting example, an infrared sensor. It will be understood that the shoe cleaning apparatus 10 can include either an actuator to move from one position to the next, automatically move from one position to the next via a sensed presence, or alternatively, that the shoe cleaning apparatus 10 can remain in a use position. The shoe cleaning apparatus 10 is illustrated in an installed, raised, retracted, and stored position under a sink 30, such as in a hospital sickroom. Such a folded position can facilitate wheelchair or access to the sink as required by the Americans with Disabilities Act.

Figure 3:
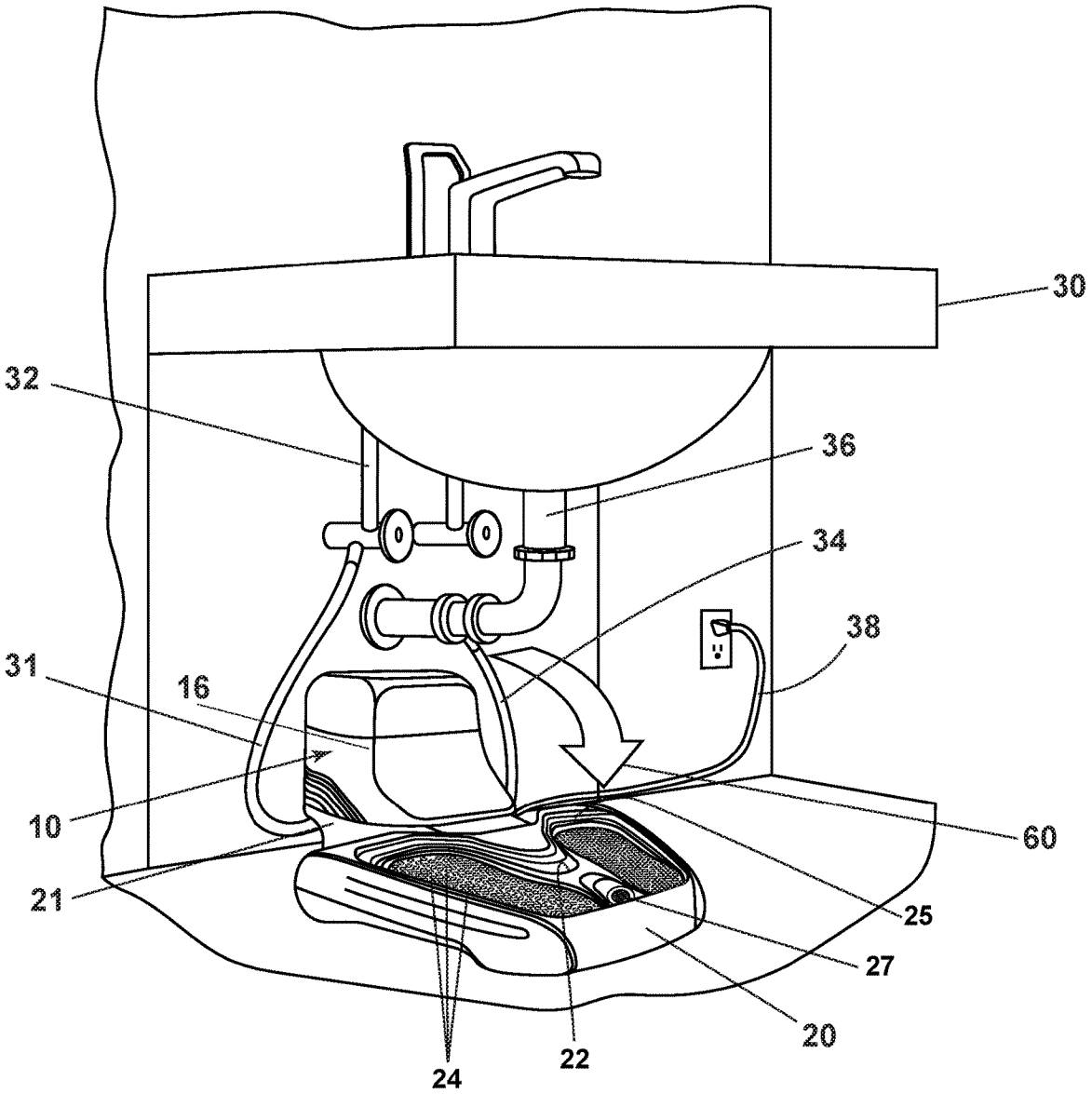
FIG. 3 is a perspective view of the shoe cleaning apparatus of FIG. 2 in a lowered and retracted position.

FIG. 3 illustrates the shoe cleaning apparatus 10 in a lowered and retracted position, where the base 20 has been lowered to rest on the floor but is still substantially under the sink 30. Arrow 60 illustrates rotational or pivoting motion of the base 20 in relation to the housing 16. As more clearly seen, the shoe cleaning apparatus 10 is fluidly coupled to plumbing infrastructure of the building. More specifically, an inlet fluid conduit 31 can fluidly couple a water tap to the shoe cleaning apparatus 10, including the fluid delivery system 12. An outlet conduit 34 fluidly couples the shoe cleaning apparatus 10 to a drain line 36. A power source 38 is also illustrated as being coupled to a building mains line. The power source 38 can provide power for the shoe cleaning apparatus 10, such as via a battery pack or wall outlet in non-limiting examples, and can provide alternating current (AC) or direct current (DC) power as desired.

Figure 4:
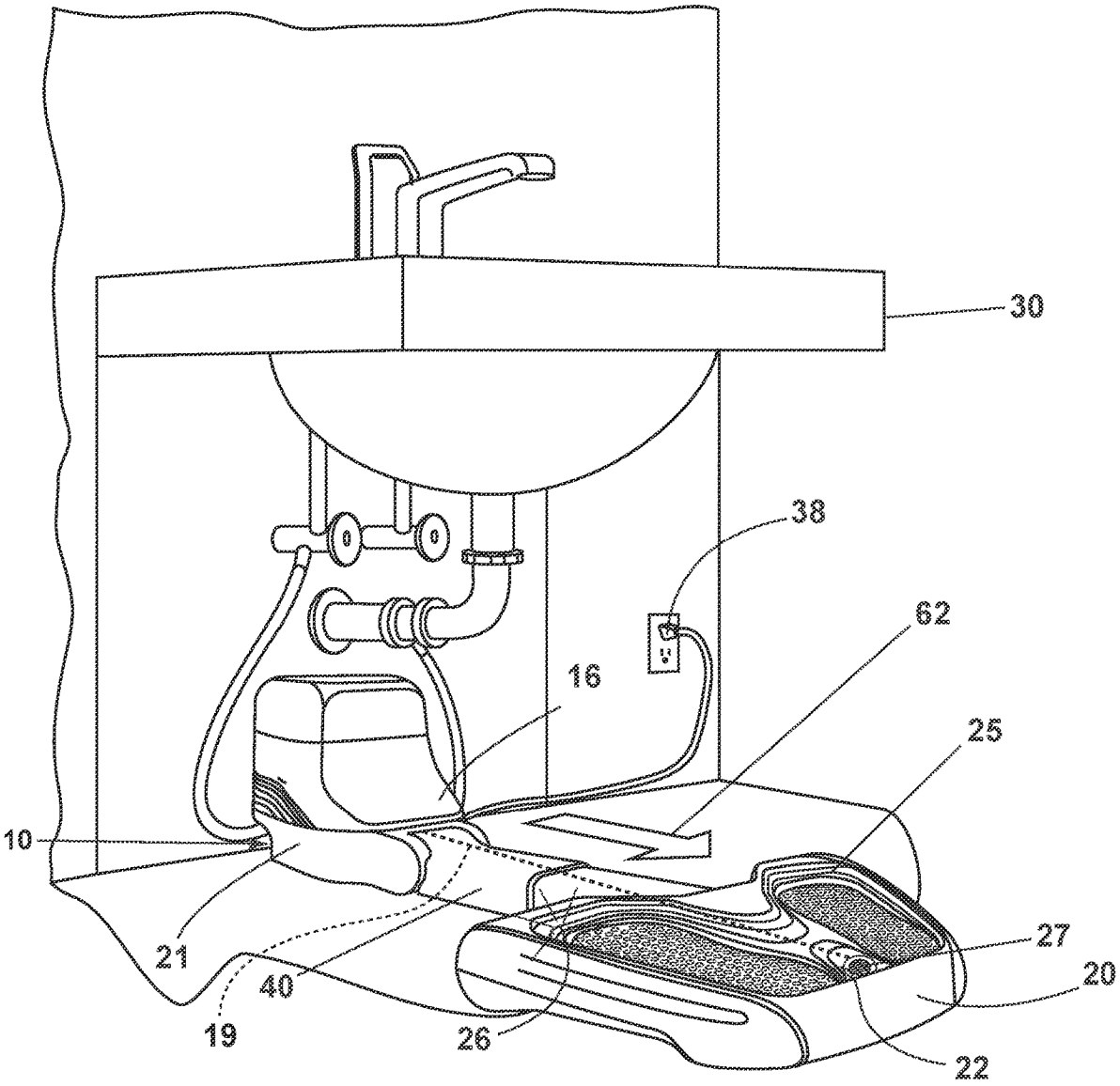
FIG. 4 is a perspective view of the shoe cleaning apparatus of FIG. 2 in a lowered and extended position.

FIG. 4 is a perspective view of the shoe cleaning apparatus 10 still in a lowered position resting on the floor and in an extended position where the base 20 is spaced from the housing 16 and stationary portion 21. Arrow 62 illustrates movement of the base 20 away from the housing 16. As can be seen a telescoping mechanism 40 is included and can operably couple the base 20 with the housing 16 and stationary portion 21. The telescoping mechanism 40 can house any conduits, pathways, power couplings, etc. to provide functionality to the base 20. The telescoping mechanism 40 can be any suitable flexible sheathing. The illustrative example of FIG. 4 can be considered a use position although it will be understood that depending on the locale of the shoe cleaning apparatus 10 the lowered and retracted position can also be considered a use position.

Regardless of the particular implementation, the system and shoe cleaning apparatus 10 shown in FIG. 1 can be used to effectively remove debris and bacteria from the footwear of a user to be cleaned in accordance with the following method. In operation, the shoe cleaning apparatus 10 is prepared for use by coupling the shoe cleaning apparatus 10 to the power source 38, and by fluidly coupling the shoe cleaning apparatus 10 to the building plumbing. Alternatively, if the shoe cleaner is a standalone device the apparatus can be prepared by filling the container(s) with cleaning fluid.

An operational example will be explained, with respect to the shoe cleaning apparatus 10 being installed under the sink 30 as in FIGS. 1-4. During operation, the motion sensor 28 detects a presence of the user as the user approaches the sink 30. The shoe cleaning apparatus 10 then deploys automatically. A motor or hydraulic actuator (not shown) operably coupled to the telescoping mechanism 40 operates to extend the base 20 from the retracted to the extended position. After deployment to the extended position, cleaning fluid is selectively delivered to the platform 22 via the fluid delivery system 12 of the shoe cleaning apparatus 10. By way of non-limiting example, the fluid distributor 25 can be located at a first end of the platform 22 opposite the at least one inlet 27 for the recovery system 14. It is contemplated that the platform 22 may be slightly tilted downwards toward the at least one inlet 27 to direct cleaning fluid from the fluid distributor 25 towards the at least one inlet 27. Simultaneously or thereafter, the recovery system 14 can be operated and the shoe cleaning apparatus 10 draws in fluid and debris-laden working air through at least one suction nozzle or the at least one inlet 27 and into the downstream recovery container 15 where the fluid debris is substantially separated from the working air. The airstream then passes through the suction source 18, which may be in the form of a motor/fan assembly prior to being exhausted from the shoe cleaning apparatus 10. The recovery container 15 can drain to the drain line 36 or alternatively be periodically emptied of collected fluid and debris. For example, in a standalone unit the recovery container 15 would be periodically emptied. It is contemplated that a cleaning via operation of the fluid delivery system 12 and the recovery system 14 either sequentially or simultaneously can be operated for twenty seconds during each cycle.

UV light emitting element 26 can be controlled to emit ultraviolet light during this time. For example, the light emitting element emits UVC light which can provide surface sanitization and disinfection properties. It is well-known that UVC light exposure has a germicidal effect and can eradicate odor-causing bacteria by destroying the DNA and RNA of microbes, thus rendering them impotent and unable to multiply. Surface sanitization and disinfection is best achieved with a light source having a UVC wavelength of about 260 nanometers. However, a range of about 280 to about 200 nanometers is also acceptable. It is contemplated that UVC light can be emitted for at least eight seconds. Alternatively, the light emitting element can be selected to enhance stain removal performance or activate certain cleaning chemical compositions. For example, it is known that illuminating certain peroxygen cleaning compounds with UVA light can improve cleaning efficacy and decrease the cleaning cycle time.

While the user is standing on the platform the nubs 24 can provide agitation on the footwear and can cause dirt or debris to break into smaller pieces while being liberated from the footwear. The nubs 24 are not shown with as much clarity in FIGS. 2-4; however, it will be understood that they are the same as the numbs with respect to those illustrated in detail in FIG. 1. The nubs 24 can include an extended or depressed state. The nubs 24 can also optionally include a ribbed abrasive contact area with origami side fold structures. Openings in the nubs can also be included to allow liquid to enter an interior of the nub and expand the nub. A transparent gel substrate can be located below the nubs and a UV light emitting element can be located there below. The ultraviolet light can permeate the gel, platform, and nub structures to sanitize the footwear. Downward pressure applied to the platform can also act to move the nubs in a twisting action, which can aid in mechanically removing debris and dirt from the footwear. Further still it is contemplated that a clean water channel can be provided between nubs to provide them with hydraulic fill. A dirty fluid or extraction channel can couple alternating or other rows of nubs.

Liberated dirt or debris can be directed through the suction nozzle(s) or the at least one inlet 27 and to the recovery container 15 via the suction source 18. While not illustrated it is also contemplated that a moveable agitator can be provided adjacent to the platform 22. Some examples of agitators include, but are not limited to, a horizontally-rotating brushroll, dual horizontally-rotating brushrolls, one or more vertically-rotating brushrolls.

An indicator can be located behind the faucet of the sink 30, or otherwise located, to provide an indication that a cycle of the shoe cleaning apparatus 10 is completed. It is contemplated that the shoe cleaning apparatus 10 can be integrated in the hand washing station or sink 30 to combine the activity for users. Hospital guidelines often require caregivers to wash or sanitize hands for approximately twenty seconds. Placing the shoe cleaning apparatus 10 in such a locale allows for shoes to be cleaned while hands are being cleaned to combine activities and save time. Once a user dismounts from the shoe cleaning apparatus 10 the base 20 can return to the retracted and raised position shown in FIG. 2.

Figure 5:
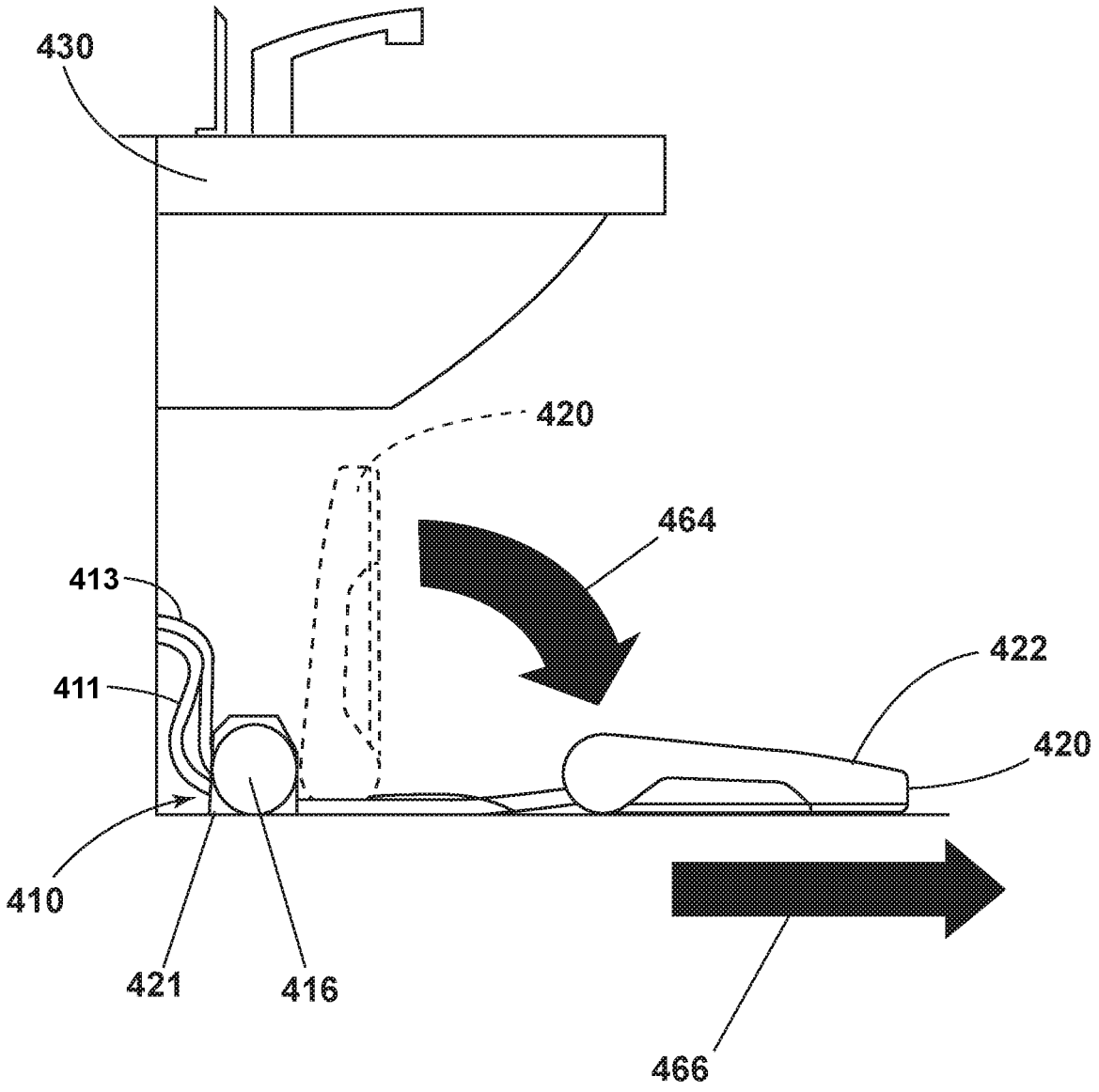
FIG. 5 is a side schematic view of a shoe cleaning apparatus in multiple positions.

FIG. 5 illustrates an illustrative system including a shoe cleaning apparatus 410 for cleaning shoe(s) of a user while wearing. The system and shoe cleaning apparatus 410 is similar to the shoe cleaning apparatus 10 and therefore, like parts will be identified with like numerals increased by 400, with it being understood that the description of the like parts of applies to the shoe cleaning apparatus 410, unless otherwise noted. Much like the early description a moveable base 420 including a platform 422 is included. One difference is the shoe cleaning apparatus 410 is lower profile and does not include containers for fluid delivery and recovery. Instead the shoe cleaning apparatus 410 can include fluid systems that directly or selectively couple with plumbing infrastructures such as a water inlet 411 and drain line 413. It is contemplated that a treating chemistry container (not shown) can still be included within the housing 416 within the stationary portion 421 of the shoe cleaning apparatus 410.

The shoe cleaning apparatus 410 is illustrated in phantom in the stored position and arrow 464 and arrow 466 illustrate the shoe cleaning apparatus 410 moving to the lowered and extended position, respectively, which can also be considered the use position. It will be understood that the shoe cleaning apparatus 410 operates much the same way as the shoe cleaning apparatus 10 and thus the description of the operation will not be repeated.

It will be understood that the shoe cleaning apparatus can alternatively be portable with cordless platforms or footpads. Additionally or alternatively, the shoe cleaning apparatus can include a one or more closure members configured to move to cover the platform when not in use. Further still, a dirty fluid tray that can be easily removed as well as a reflective upper panel including at least one reflective element configured to reflect UV light provided to the platform can be included. The reflective elements can be any elements having reflective properties, such as strips of foil or glass forms. Tanks accessible from the side with indented grips formed thereon can be included along with indicators or lights.

It is contemplated that a system including the shoe cleaning apparatus can also include one or more storage options. For example, an entry station could include an ultraviolet light located above garments such that garments can be sanitized by ultraviolet light. A tablet holder or shelving could be included. Other examples allow for wheelchair sanitization.

It will be understood that a variety of cleaning technologies can be utilized alternatively or in combination with the shoe cleaning apparatus to aid in cleaning footwear. By way of non-limiting example, brush pins that can rise to a profile, geometry, or topography or a bottom surface of a sole of a user's shoe(s) can be utilized. Such brush pins can incorporate UV lighting including but not limited to light pipe technology to provide for sanitization of the bottom surface of the sole from a UV light emitting element. The brush pins can include an abrasive tip that can be moveably operated to remove dirt and other foreign contaminants. It is contemplated that the brush pins can be rotated or vertically moved to create a mechanical action. Further still, a plurality of the brush pins can be moved at once of each individual brush pin can be controlled for movement. It will be understood that any suitable actuator(s) and controller can be included to control operation such that the brush pins can be configured to provide for cleaner footwear.

A platform with a plurality of tabs can be included and can conform to contours of an underside of the footwear. Further still, a seal, which can include a band that tightens about the sole of the footwear can be included. A moveable assembly includes a vacuum inlet, liquid distributor, and agitator in the form of a brush can also be included. The moveable assembly can slide back and forth below the shoe. Further still, a UV light emitting element can be located thereunder to allow for sanitization of the bottom surface of the sole.

A platform could also be optionally formed by a thin grate and a series of vacuum inlets and steam outlets located thereunder. It is contemplated that liquid distributors can also be included. During operation, steam from steam outlets can break up the dirt, a cleaning solution from liquid distributors can be used to rinse the dirt away and/or the dirt can be vacuumed away by vacuum inlets. Further still, a portion of the platform can be transparent to allow ultraviolet light to pass through from a UV light emitting element to allow for sanitization of the bottom surface of the sole.

A platform can also be located above a scanner or sensor(s). The sensor(s) can provide a topology or topography of an underside of a user's footwear and operate a brush assembly based thereon. The brush assembly is illustrated with a plurality of brush heads located about a liquid distributor. The brush heads are moveable via a linear actuator and a rotational actuator and are operably coupled thereto via one or more gears or pins. The brush assembly includes a carriage moveable along a set of rails although this is for illustrative purposes only.

Aspects of the present disclosure provide for a variety of benefits, including that the use of a shoe cleaning apparatus can provide for sanitation of a user's shoes to aid in preventing the spread of diseases and protect indoor spaces from harmful chemicals and dirt by cleaning a bottom portion of a user's shoes. Bacteria and viruses can be effectively eliminated with UVC radiation while dirt and other debris can be removed with a cleaning fluid or mechanical action. Further still, the apparatus as described herein includes additional benefits such as prolonging lifespan of footwear and improving aesthetics of footwear This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are provided by the subject matter of the following clauses:

A shoe cleaning apparatus, including a housing assembly operably coupled to the platform, a platform having an upper surface adapted to receive footwear for cleaning, a fluid delivery system fluidly coupled to the upper surface and configured to provide a cleaning fluid thereto, a fluid recovery system fluidly coupled to the upper surface and including a suction source.

The shoe cleaning apparatus of any preceding clause, further comprising at least one fluid container removably mounted to the housing and adapted to contain the cleaning fluid.

The shoe cleaning apparatus of any preceding clause, further comprising at least one recovery container removably mounted to the housing and having an air and liquid separator therein.

The shoe cleaning apparatus of any preceding clause wherein the fluid recovery system includes an inlet in communication with the recovery container for drawing soiled cleaning fluid recovered from the upper surface.

The shoe cleaning apparatus of any preceding clause, further comprising a working air conduit extending from the inlet to the recovery container.

The shoe cleaning apparatus of any preceding clause wherein at least a portion of the working air conduit is telescopic.

The shoe cleaning apparatus of any preceding clause wherein the platform is pivotably coupled to the housing assembly.

The shoe cleaning apparatus of any preceding clause wherein the platform is moveable between a first stored position and second extended position wherein the platform is further from the housing assembly than in the stored position.

The shoe cleaning apparatus of any preceding clause, further comprising a sensor located on one of the housing assembly or the platform and configured to sense a presence of a user.

The shoe cleaning apparatus of any preceding clause, further comprising an actuator configured to move the platform to the second extended position.

The shoe cleaning apparatus of any preceding clause, further comprising a controller communicatively coupled with the sensor to receive an output therefrom, with the actuator to control operation of the actuator, with a pump of the fluid delivery system, and the suction source of the fluid recovery system.

The shoe cleaning apparatus of any preceding clause wherein the controller is configured to operate the pump and the suction source during a twenty second cycle of operation.

The shoe cleaning apparatus of any preceding clause, further comprising a UV lighting element operably coupled to the controller, the UV lighting element located adjacent a portion of the platform and configured to emit UVC light or UVA light.

The shoe cleaning apparatus of any preceding clause wherein at least one of the at least one fluid container of the at least one recovery container is fluidly couplable to a plumbing infrastructure of a building.

The shoe cleaning apparatus of any preceding clause wherein the platform is moveable between a first stored position and second use position wherein at least a portion of the platform is further from the housing assembly than in the stored position.

The shoe cleaning apparatus of any preceding clause, further comprising a sensor located on a lower surface of the platform and configured to sense a presence of a user when the platform is in the first stored position.

The shoe cleaning apparatus of any preceding clause wherein the platform is hingedly coupled to the housing assembly and further comprising an actuator configured to move the platform to the second use position.

The shoe cleaning apparatus of any preceding clause, further comprising a controller communicatively coupled with the sensor to receive an output therefrom, with the actuator to control operation of the actuator, with a pump of the fluid delivery system, and the suction source of the fluid recovery system.

The shoe cleaning apparatus of any preceding clause wherein a set of nubs are located on the upper surface of the platform and configured to agitated a surface of footwear received thereon.

The shoe cleaning apparatus of any preceding clause wherein the housing assembly is portable.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A shoe cleaning apparatus, comprising:

a housing assembly;

a platform having an upper surface adapted to receive footwear for cleaning, the platform operably coupled to the housing assembly, wherein the platform is moveable between a first stored position and a second use position wherein the platform is further from the housing assembly than in the first stored position;

a fluid delivery system fluidly coupled to the upper surface and configured to provide a cleaning fluid thereto;

a fluid recovery system fluidly coupled to the upper surface and including a suction source;

a sensor located on one of the housing assembly or the platform, the sensor configured to sense a presence of a user;

an actuator configured to move the platform to the second use position; and a controller communicatively coupled with the sensor to receive an output therefrom to move the platform from the first stored position to the second use position, the controller communicatively coupled with a pump of the fluid delivery system, and the controller communicatively coupled with the suction source of the fluid recovery system.

2. The shoe cleaning apparatus of claim 1, further comprising at least one fluid container removably mounted to the housing assembly and adapted to contain a supply of the cleaning fluid.

3. The shoe cleaning apparatus of claim 1, further comprising at least one recovery container removably mounted to the housing assembly and having an air and liquid separator therein.

4. The shoe cleaning apparatus of claim 3 wherein the fluid recovery system includes at least one inlet in communication with the at least one recovery container through which the suction source is configured to draw soiled cleaning fluid therethrough.

5. The shoe cleaning apparatus of claim 4, further comprising a working air conduit extending from the at least one inlet to the at least one recovery container.

6. The shoe cleaning apparatus of claim 5 wherein at least a portion of the working air conduit is telescopic.

7. The shoe cleaning apparatus of claim 6 wherein the platform is pivotably coupled to the housing assembly.

8. The shoe cleaning apparatus of claim 1 wherein the controller is configured to operate the pump and the suction source during a twenty second cycle of operation.

9. The shoe cleaning apparatus of claim 1, further comprising a UV lighting element operably coupled to the controller, the UV lighting element located adjacent a portion of the platform and configured to emit UVC light or UVA light.

10. The shoe cleaning apparatus of claim 1, wherein the sensor is located on a lower surface of the platform.

11. The shoe cleaning apparatus of claim 10 wherein the platform is hingedly coupled to the housing assembly.

12. The shoe cleaning apparatus of claim 1 wherein a set of nubs are located on the upper surface of the platform and configured to agitated a surface of footwear received thereon.

13. The shoe cleaning apparatus of claim 1 wherein the housing assembly is portable.

14. The shoe cleaning apparatus of claim 1 wherein the fluid delivery system comprises at least one fluid container and the fluid recovery system comprises at least one recovery container, and wherein at least one of the at least one fluid container and the at least one recovery container is fluidly couplable to a plumbing infrastructure of a building.

15. A shoe cleaning apparatus, comprising:

a platform having an upper surface adapted to receive footwear for cleaning and comprising a fluid distributor and a suction inlet;

a fluid delivery system configured to provide a cleaning fluid to the platform, the fluid delivery system comprising the fluid distributor and a pump controlling a flow of fluid to the fluid distributor;

a fluid recovery system configured to draw soiled cleaning fluid away from the platform, the fluid recovery system comprising the suction inlet, a suction source in fluid communication with the suction inlet, and at least one recovery container;

a housing assembly coupled with a rear portion of the platform, wherein the pump, the suction source, and the at least one recovery container are contained within the housing assembly; and wherein the platform is moveable between a first stored position adjacent to the housing assembly and a second use position wherein the platform is further from the housing assembly than in the first stored position an actuator configured to move the platform to the second use position;

a controller communicatively coupled with the actuator to control operation of the actuator; and a sensor configured to sense a presence of a user, wherein sensed user presence is used control movement of the platform to the second use position.

16. The shoe cleaning apparatus of claim 15 wherein the platform is at least one of:

pivotably coupled to the housing assembly; and telescopically coupled to the housing assembly.

17. The shoe cleaning apparatus of claim 15 wherein the at least one recovery container is removable from the housing assembly and includes an air and liquid separator therein.

18. The shoe cleaning apparatus of claim 15 wherein the at least one recovery container is fluidly couplable to a plumbing infrastructure of a building.

* * * * *